United States Patent [19]

McGinn et al.

[11] 4,034,806

[45] July 12, 1977

[54] TUBING SIDE POCKET MANDREL

[75] Inventors: Ferdinand M. McGinn; Gerald P. Hebert, both of Lafayette, La.

[73] Assignee: Production Specialties, Inc., Lafayette, La.

[21] Appl. No.: 722,533

[22] Filed: Sept. 13, 1976

[51] Int. Cl.[2] ..... E21B 23/00

[52] U.S. Cl. ..... 166/117.5

[58] Field of Search ..... 166/117.5

[56] References Cited

U.S. PATENT DOCUMENTS

| | | | |
|---|---|---|---|
| 2,942,671 | 6/1960 | Schramm | 166/117.5 |
| 2,948,341 | 8/1960 | Fredd | 166/117.5 |
| 2,988,146 | 6/1961 | Fredd | 166/117.5 |
| 3,353,607 | 11/1967 | Kinley | 166/117.5 |
| 3,827,490 | 8/1974 | Moore, Jr. et al. | 166/117.5 |

*Primary Examiner*—James A. Leppink
*Attorney, Agent, or Firm*—Jack W. Hayden

[57] ABSTRACT

A mandrel for use in a well tubing in which the mandrel body has an open bore for alignment with the well tubing and an enlargement offset from the open bore with a side pocket therein for receiving a flow control device. A combination guard and guide has a body which forms part of the mandrel offset and is positioned above the side pocket to prevent access to the pocket except by a predetermined size member. A projection is provided between the combination guard and guide and the side pocket to assist in retaining a flow control device in position in the pocket. An orienting sleeve is mounted in the open bore of the mandrel above the pocket for aligning a flow control device to be positioned in the pocket, which orienting sleeve comprises a tubular body having a tapered lowered end and a first longitudinal slot angularly disposed relative to the mandrel offset in a predetermined relationship. The first longitudinal slot terminates in spaced relation to the top end of the sleeve and a second slot communicates with the top end of the slot to provide a means for discharging trash and debris from the slot.

2 Claims, 5 Drawing Figures

TUBING SIDE POCKET MANDREL

SUMMARY OF THE INVENTION

When side pocket mandrels are employed in a deviated well bore, some difficulty may be encountered in positioning a flow control device in a valve receiving pocket in the side pocket of the mandrel. Additionally, it is desirable to preclude entry into the valve pocket of anything other than the desired flow control device, and since anything moving through a tubing string in a deviated well bore would normally seek the low side, and since the relationship of the side pocket to the low side cannot be controlled, it is desirable to provide a guard which selectively controls access to the valve pocket formed in the side pocket.

The present invention contemplates an orienting sleeve aligned in the main bore of the mandrel and positioned in spaced relation to the valve receiving pocket which is provided with a first longitudinally extending slot which intersects the lower end of the sleeve but terminates in spaced relation to the upper end of the sleeve, with a second slot communicating the upper end of the first slot with the upper end of the orienting sleeve to permit trash and debris to escape therefrom. A guard having a semicylindrical body forming part of the offset portion of the mandrel with longitudinally extending sides and a vertical edge surface on each side which faces the open bore of the mandrel provides a means for selectively restricting access to the valve pocket positioned immediately therebeneath so that only predetermined flow control devices may be positioned in the valve receiving pocket. In addition, a projection is provided between the guard and the valve receiving pocket to assist in retaining flow control devices in position in the valve pocket.

DESCRIPTION OF THE PREFERRED EMBODIMENT

Figure 1:
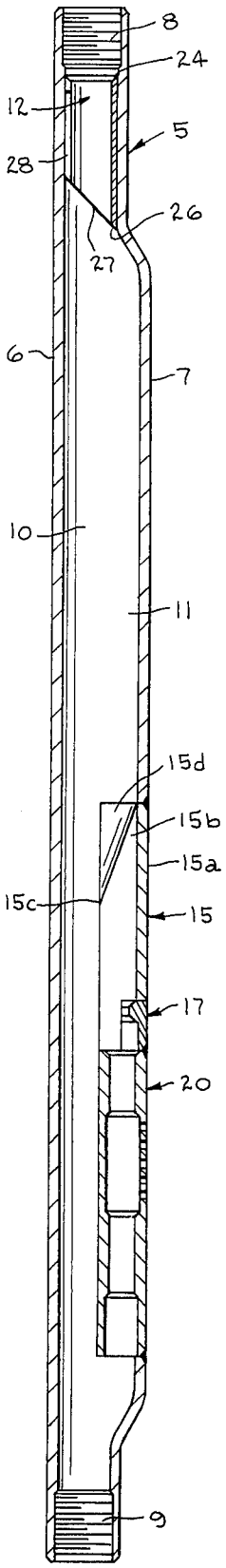
FIG. 1 is a vertical sectional view of the mandrel of the present invention showing the orienting sleeve aligned in the main bore, the combination guide and guard and the valve pocket formed in the offset portion of the mandrel.
Figure 3:
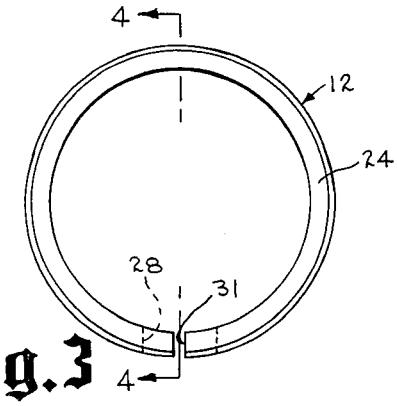
FIG. 3 is a top end view of the orienting sleeve shown in FIG. 2.

In FIG. 1 the mandrel of the present invention is referred to generally by the numeral 5 and includes the longitudinally extending body 6 having a bulge or offset portion extending longitudinally thereof as shown at 7. Threads 8 and 9 are provided in each end of the body 6 to enable the mandrel to be secured in position in a well tubing. It will be noted that the longitudinally extending body 6 provides a main bore 10 with the lateral enlargement 7 having an offset bore portion illustrated at 11.

An orienting sleeve 12 is aligned in the main body bore 10 at the upper end of the mandrel, and a combination guide and guard 15 is provided in the offset bore 11 as is the valve receiving pocket 20. It will be noted that the combination guide and guard 15 is positioned immediately above the valve receiving pocket 20 and projection means 17 are provided between the guard and the valve receiving pocket to assist in retaining a flow control device such as a valve in position in the valve receiving pocket 20 after it has been positioned therein.

One advantage of a side pocket mandrel is that it enables well tools to be run into the tubing without the necessity of removing flow control valves from the tubing to provide access for the devices run in the tubing. However, when the side pocket mandrel is employed in a deviated well, the offset mandrel may be positioned such that as tools are moved through the tubing, they tend to move into the offset portion 11 and enter into the valve pocket 20. Also, mandrels presently in use which employ an orienting sleeve to enable the flow control device to be aligned and positioned in the valve receiving pocket 20 include a slot which has a closed end thereon. In some instances, debris may collect in the slot thus interfering with, or making more difficult the positioning of a flow control device so that it can be readily positioned through the guard and guide 15 and into the valve receiving pocket 20.

Figure 2:
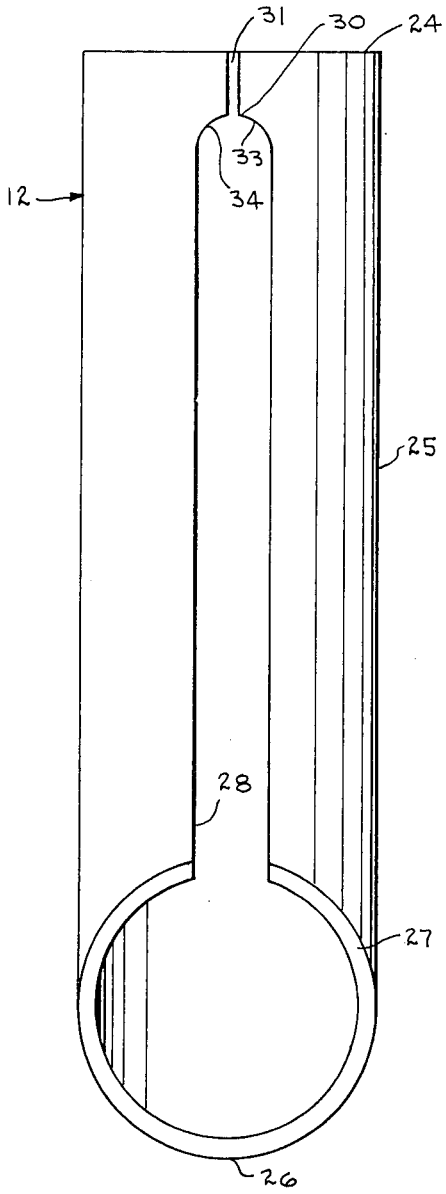
FIG. 2 is a view of the orienting sleeve showing the arrangement of the slots therein.
Figure 4:
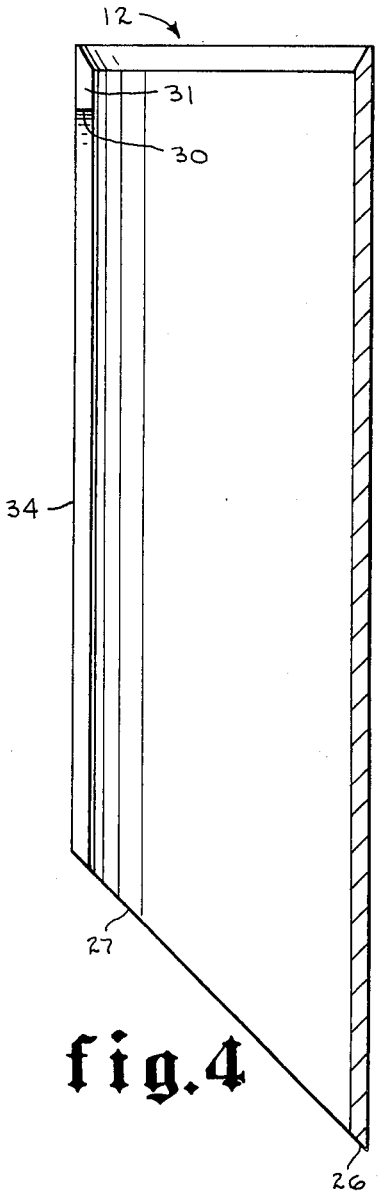
FIG. 4 is a sectional view on the line 4—4 of FIG. 3.

The orienting sleeve 12 of the present invention overcomes any problem that might occur along this line and as shown in FIG. 2, it includes an elongated hollow tubular body 25 having an upper end 24 and a lower end 26. It will be noted that the lower end 26 is cut on an angle or incline relative to the longitudinal axis of the elongated hollow tubular body 25 so that a tapering guide surface 27 is formed thereon. It will also be noted that the incline of the lower end 26 is upwardly and away from the offset bore 11 and that a slot 28 extends from the highest portion of the guide surface 27 longitudinally of the elongated tubular body 25 and terminates in spaced relation to the upper end 24 as illustrated at 30. A second slot 31 extends from the termination 30 of the first slot 28 and intersects the upper end 24 of the elongated hollow tubular body 25 as shown in the drawings. It will be noted that the width of the second slot 31 relative to the first slot 28 is relatively slight, but it does provide a flow path for the discharge of debris, trash, or other matter that might tend to collect in the slot 39 when it is in position in the mandrel 5 as illustrated in FIG. 1 of the drawings.

It will also be noted that the intersection of the second slot 31 with the upper end 30 of the first slot 28 provides a pair of shoulders 33 and 34 which are spaced from each other by the slot 31, and which provide a means to enable a tool of well known design to be engaged with such shoulders 33 and 34 to align a flow control device in the offset portion 11 with the combination guide and guard for receiving such flow control device therethrough and into the valve pocket 20.

Figure 5:
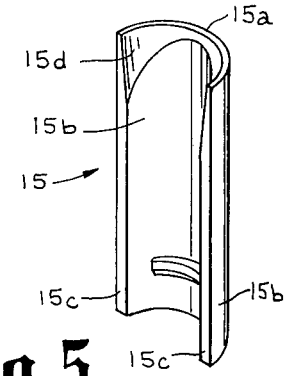
FIG. 5 is a perspective view of the combination guide and guard.

The combination guide and guard 15 is formed of a longitudinally extending member which is generally "U" shaped in configuration the base 15*a* of the U forming part of the body of the enlargement 7 in the mandrel 5. It includes a pair of sides, one of which is shown at 15*b* and the other at 15*d* in FIG. 5, which face the open bore 10 with each side having a longitudinally and vertically extending edge 15*c*. The sides of the combination guide and guard along with the base 15*a* form a body of generally semicircular configuration, and the sides are spaced apart, and face inwardly towards the main body bore 10 of the mandrel 5. The distance between the spaced sides of the guard 15 along with the tapering surface 15*d* at the upper inner end thereof provide an arrangement for restricting access to the valve pocket 20 immediately therebeneath. Since the combination guide and guard 15 is semicircular in configuration it can be appreciated that the sloping surface 15 is also curved at the upper end thereof by reason of the semicircular configuration of the guard.

In utilizing the present invention, a kick-over tool such as that shown in application Ser. No. 705,144 filed in the U.S. Patent Office on July 14, 1976 for "Positioning Tool" is lowered into the tubing and when it is positioned in the desired mandrel, an upward pull on the supporting cable or string on which it is positioned in the tubing engages the tool with the guide surface 27 and eventually with the shoulders 33 and 34 in the slot 28 and moves the tool into position so that it aligns with the combination guide and guard 15 to enable a flow control device supported on the tool to be seated in the valve receiving pocket 20. It can be appreciated that the sloping surface 27 enables the lug on the kick-over tool to be guided into matching relationship with the slot 28 to enable the kick-over tool to be actuated in a manner well known in the art. After the flow control device has been positioned in the valve receiving pocket, the tool may be retrieved from the well bore.

Thus, the orienting sleeve 12 properly aligns and orients a tool carrying a flow control device with the offset portion 11 of the mandrel to enable the flow control device to be seated through the combination guide and guard 15 and into the valve receiving pocket 20. Also the combination guide and guard 15 selectively restricts access to the valve receiving pocket 20 so that as other tools are moved through the tubing string, they are prevented from engaging in the valve receiving pocket or becoming hung up therein.

The arrangement of the slots in the orienting sleeve 12 inhibits collection of debris in the slot 28, and enables such debris to flow through the slot 28, 31 and into the tubing to prevent obstruction of slot 28 by any accumulation of debris, trash or paraffin.

The foregoing disclosure and description of the invention are illustrative and explanatory thereof, and various changes in the size, shape, and materials as well as in the details of the illustrated construction may be made without departing from the spirit of the invention.

What is claimed is:

1. In a mandrel for use in a well tubing in which the mandrel body has an open bore for alignment with the well tubing and a pocket offset from the open bore for flow control devices, the invention comprising:

a. a combination guide and guard aligned with the pocket, said guide and guard including:
   1. a semicircular housing forming part of the mandrel;
   2. sides facing towards the open bore;
   3. a curved sloping surface on the upper inner end of said semicircular housing which permits only flow control devices of predetermined size to pass therethrough and into the pocket; and
   4. vertically extending edge surfaces formed on the inner end of each of said sides, b. projection means between the pocket and the combination guide and guard to retain flow control devices in the pocket;

c. an orienting sleeve in the open bore above the pocket for aligning a flow control device to be positioned in the pocket, said orienting sleeve including:
   1. an elongated hollow tubular body having an upper and lower end;
   2. said lower end extending upwardly at an angle relative to the longitudinal axis of said tubular body to form a sloping guide surface which extends upwardly and away from the pocket;
   3. a first slot extending longitudinally of said tubular body from the highest portion of said guide surface, said first slot terminating in spaced relation to said upper end of said tubular body;
   4. a second slot extending from the upper end of said first slot to the upper end of said tubular body; and
   5. said second slot being substantially smaller in width than said first slot to form a pair of aligned shoulders at the juncture of said first and second slot which are spaced from each other by said second slot whereby debris may discharge from said first slot through said second slot and into the tubing.

2. A well installation comprising:

a. a well tubing having a plurality of identical mandrels each having an open bore for alignment with the well tubing and a pocket offset from the open bore for receiving flow control devices;

b. a combination guide and guard aligned with the pocket, said guide and guard including:
   1. a semicircular housing forming part of the mandrel;
   2. sides projecting radially towards the open bore;
   3. a curved sloping surface on the upper inner end of said semicircular housing which permits only flow control devices of predetermined size to pass therethrough and into the pocket; and
   4. vertically extending edge surfaces formed on the inner end of each of said sides.

c. an orienting sleeve in the open bore above the pocket of each mandrel for aligning a flow control device to be positioned in the pocket, each sleeve of each mandrel including;
   1. an elongated hollow tubular body having an upper and lower end;
   2. said lower end extending upwardly at an angle relative to the longitudinal axis of said tubular body to form a sloping guide surface which extends upwardly and away from the pocket;
   3. a first slot extending longitudinally of said tubular body from the highest portion of said guide surface, said first slot terminating in spaced relation to said upper end of said tubular body;
   4. a second slot extending from the upper end of said first slot to the upper end of said tubular body; and
   5. said second slot being substantially smaller in width than said first slot to form a pair of aligned shoulders at the juncture of said first and second slot which are spaced from each other by said second slot whereby debris may discharge from said first slot through said second slot and into the tubing.

* * * * *